US010501246B1

(12) United States Patent
Bowles

(10) Patent No.: US 10,501,246 B1
(45) Date of Patent: Dec. 10, 2019

(54) SMART CAP FOR A LIQUID CONTAINER

(71) Applicant: Hyduro, Inc., La Jolla, CA (US)

(72) Inventor: Miles Bowles, La Jolla, CA (US)

(73) Assignee: Hyduro, Inc., La Jolla, CA (US)

( * ) Notice: Subject to any disclaimer, the term of this patent is extended or adjusted under 35 U.S.C. 154(b) by 0 days.

(21) Appl. No.: 15/727,636

(22) Filed: Oct. 9, 2017

Related U.S. Application Data

(60) Provisional application No. 62/429,798, filed on Dec. 3, 2016, provisional application No. 62/405,949, filed on Oct. 9, 2016.

(51) Int. Cl.
*B65D 51/24* (2006.01)
*B65D 51/28* (2006.01)
*B65D 41/04* (2006.01)

(52) U.S. Cl.
CPC ..... *B65D 51/248* (2013.01); *B65D 41/0492* (2013.01); *B65D 51/28* (2013.01)

(58) Field of Classification Search
CPC ..... B65D 51/248; B65D 51/245; A47G 23/16
USPC ..... 222/27
See application file for complete search history.

(56) References Cited

U.S. PATENT DOCUMENTS 9,981,790 B1 * 5/2018 Ost ..... B65D 51/245
10,078,003 B2 * 9/2018 Gurumohan ..... H04W 4/80
2007/0205203 A1 * 9/2007 Temko ..... A47G 23/16 220/712
2010/0092309 A1 * 4/2010 Hockemeier ..... A47G 21/18 417/53
2014/0324585 A1 * 10/2014 Mederos ..... G06Q 30/0257 705/14.55
2014/0353339 A1 * 12/2014 Madjar ..... A47G 19/2272 222/333
2016/0003615 A1 * 1/2016 Biswas ..... G01F 23/0076 702/151
2016/0025545 A1 * 1/2016 Saltzgiver ..... G01F 23/263 73/304 C
2016/0031721 A1 * 2/2016 Kellam ..... C02F 1/003 210/244
2016/0286993 A1 * 10/2016 Pau ..... A47G 23/16
2016/0327427 A1 * 11/2016 Briones ..... A61J 7/02
2017/0176238 A1 * 6/2017 Dubey ..... G01G 17/04
2017/0188730 A1 * 7/2017 Schuller ..... A47G 23/16
2017/0188731 A1 * 7/2017 Schuller ..... A47G 23/16
2017/0263102 A1 * 9/2017 Tshilombo ..... G08B 21/182
2017/0273488 A1 * 9/2017 Lonis ..... A47G 19/2227
2017/0332813 A1 * 11/2017 Liao ..... G01F 25/0061
2017/0340147 A1 * 11/2017 Hambrock ..... A47G 19/2227
2018/0078065 A1 * 3/2018 Cheatham ..... A47G 19/2227
2018/0132643 A1 * 5/2018 Shklar ..... G01F 23/0061

* cited by examiner

*Primary Examiner* — Jeremy Carroll

(57) ABSTRACT

A smart cap for use with a liquid container and a system therefor is disclosed herein. The components of the smart cap preferably comprise a micro motor, a microcontroller, a wireless transceiver (BTLE), a lithium ion battery, LED indicators, a waterproof rated charging port, a nozzle quick connect, a controllable valve, a touch sensor, a thermal sensor, a physical button, an impeller, and a cap housing.

3 Claims, 7 Drawing Sheets

SMART CAP FOR A LIQUID CONTAINER

CROSS REFERENCES TO RELATED APPLICATIONS

The Present Application claims priority to U.S. Provisional Patent Application No. 62/405,949, filed Oct. 9, 2016, and U.S. Provisional Patent Application No. 62/429,798 filed on Dec. 3, 2016, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to caps for liquid containers.

Description of the Related Art

The prior art discusses various hydration apparatuses.

U.S. Patent Publication Number 20030075573 is one.

U.S. Pat. No. 8,505,783 is another.

U.S. Pat. No. 7,063,243 is another.

U.S. Patent Publication Number 20150102058 is another.

PCT Publication Number WO2005007066 is yet another.

However, all of these devices fail to provide a universal smart cap for use with liquid containers.

BRIEF SUMMARY OF THE INVENTION

The present invention provides a universal smart cap for a liquid container.

One aspect of the present invention is a smart cap for a liquid container. The smart cap comprises a micro motor, a microcontroller, a wireless transceiver (BTLE), a lithium ion battery, a plurality of LED indicators, a waterproof rated charging port, a nozzle quick connect, a controllable valve, a touch sensor, a thermal sensor, a physical button, an impeller, and a cap housing.

Another aspect of the present invention is a smart cap for a liquid container. The smart cap comprises a rechargeable battery, a microcontroller (with wireless transceiver/BTLE), a centrifuge pump (micro motor and impeller), and a plurality of LED light indicators.

Yet another aspect of the present invention is a system for a smart cap for a liquid container. The system comprises a smart cap, a mobile application for a mobile device, and a liquid container. The smart cap is attached to the liquid container.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
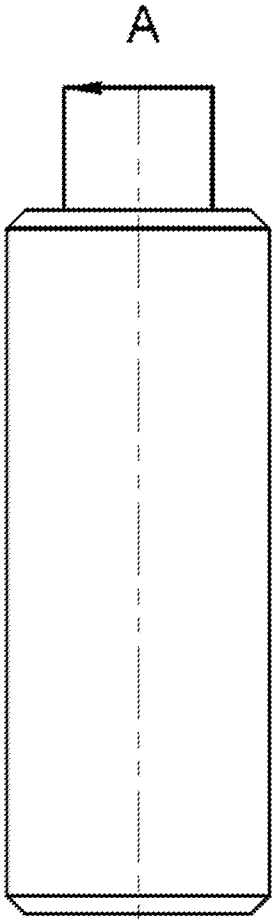
FIG. 1 illustrates a liquid container.

The present invention is a smart cap for use with a liquid container. The components of the smart cap preferably comprise a micro motor, a microcontroller, a wireless transceiver (BTLE), a lithium ion battery, LED indicators, a waterproof rated charging port, a nozzle quick connect, a controllable valve, a touch sensor, a thermal sensor, a physical button, an impeller, and a cap housing.

In one embodiment, the cap comprises a rechargeable battery, a microcontroller (with wireless transceiver/BTLE), a centrifuge pump (micro motor and impeller), and LED light indicators. An option valve may also be included.

Another embodiment is a system for the smart cap preferably comes apart into several main components for easy cleaning and interchangeability (especially with the nozzle).

A preferred system is a four piece system comprising an inner hose (possible filter accessory), a standard thread connect (piece that connects to water bottle) with inner hose inlet, a smart module with an impeller, and a nozzle.

Another embodiment of the system has a centrifuge impeller pump which doubles as a controllable valve by lowering a rubberized impeller into the intake opening of the centrifuge pump. The impeller can be lowered using manual mechanics, electric actuation, or back pressure from the fluid within the system.

Another embodiment is an all in one system (does not allow the user to take the system apart). One simple quick connect for the hose. The inner hose is still removable. The inner hose preferably has a pivoting joint that lets the angle be adjusted for use in a straight bottle of a flat bottle.

The smart cap of the present invention may be utilized with the hydration apparatus 100 of Bowles, U.S. Provisional Patent Application No. 62/405,949, filed on Oct. 9, 2016, for an Hydration Apparatus, which is hereby incorporated by reference in its entirety.

The smartcap preferably has an electric motor impeller, rechargeable battery, controller board, a wireless transceiver, controllable open/shut valve, charging port, activation button. It may still dynamically rotate. The smart cap also has a male-ended quick-connect nozzle for easily attaching the hose.

The smart cap may include a rotary-type positive displacement pumps selected from the group comprising an impeller pump, a flexible impeller pump, a rotary lobe pump, a velocity pump, an impulse pump, a gravity pump, a root-type pump, a valveless pump, a centrifugal pump, a rotary vane pump, a flexible vane pump, a circumferential piston pump, a rotary gear pump, a gear pump, a screw pump, a liquid ring pump, a helical twisted roots pump, a peristaltic pump, and a progressive cavity pump.

Alternatively, the smart cap may include a reciprocating pump selected from the group comprising a piston pump, a diaphragm pump, a positive displacement pump, a plunger pump, a radial piston pump and a hydraulic pump.

The smart cap preferably has an attachable hard-cover for extra protection and personalization. The cover allows for its own set of accessories such as including a built-in spot to carry your mobile device, wallet, keys, snack, etc. A solar panel for charging of electric cap or mobile device is optional. The hard shell could also have areas to clip system to a utility vest or backpack.

A smart cap preferably has a removable reservoir for easy cleaning and replacement. It also allows for the possibility of providing different types of reservoir inserts. For example a standard insert, an insulated insert, an infusion insert, an anti-slosh insert, a flavor-enhancing insert, etc.

The smart cap preferably has a stretchable hose to eliminate dreadful hose dangle. The hose will also have a wire that connects the cap to the hose nozzle allowing the smart cap to be controlled from a button on the nozzle while connected to the hose.

The smartcap is powered, and uses electric motor to expel water.

The smart cap is preferably wirelessly controllable, and connects via smartphone app to allow for control over settings and usage data.

The smart cap is preferably easy to clean, and it has a smart cleaning mode where cap runs motor backwards and forwards in bursts to remove unwanted buildup and clean cap internals. It works best when user puts soap water in system before activating smart cleansing mode. It is also dishwasher safe (it can be disassembled easily and the impeller can be removed for unblocking jams).

The smart cap preferably has a waterproof charging port. The charging port is waterproof allowing the smart cap to come with you wherever your adventures take you.

The smart cap preferably has a custom measured gulp (burst) size, which allows a user to fine-tune smart caps settings to have it deliver the perfect amount of water each time with absolute accuracy and precision. A user uses the smart cap to measure out precise volumes. Potential applications include: measuring liquids while camping, rationing water throughout a race or athletic event, tracking your daily consumption.

The smart cap preferably has an adaptive gulp size. It uses data feedback from your smartwatch or heart rate sensor to intelligently resize your gulp depending on your current respiratory state.

When your heart and respiratory rates are high, you are in the most need of water however you are breathing fast and hard. Our smart cap recognizes this and automatically adjusts your gulp size down to allow you to get a quick sip in between breaths. It also increases the rate at which it notifies you to drink so that you still get enough water to keep you going.

The smart cap preferably has liquid tracking. The smart cap will keep track of the amount of water you drink. A user uses a mobile app to keep track of the user's drinking habits so as to get better insight into the user's health. A user can compare drinking habits with other health metrics such as athletic performance, heart rate, respiratory rate, etc. A user can compare data anonymously against a large community of users to see where the user stacks up. Help advance public knowledge of how good drinking habits really do affect healthy living and performance. See a report on how much of an impact you've made on the environment by reducing consumption of plastic non reusable water bottles.

The smart cap preferably has a display. The readout display shows current daily water consumption, battery life, mode, settings, etc.

The smart cap alternatively has a modular nozzle. It incorporates a modular nozzle connect for personalizing nozzle styles and attaching hose.

The smart cap alternatively has an activation button bypass. When a hose is connected, a cap activation is switched from cap to hose nozzle. This will likely be done via wire connection or short signal wireless connection.

One embodiment is a water bottle cap with the all the previously mentioned components and a sensor that tracks the rotations of the motor/impeller and uses algorithms to convert that information into data on how much liquid the user has consumed. In other words, the cap as previously mentioned with a sensor for tracking the amount of liquid expelled.

The smart cap also preferably has rotational tracking of the motor.

The App features preferably comprise a hardware battery life, a daily goal tracking, a performance optimization, and a statistics view.

The statistics view preferably comprises performance comparisons, overall usage, environmental impacts, health impacts and charitable impacts.

The App settings preferably comprise layout & style, accessibility and integrations.

The hardware settings preferably comprise burst volume, Bluetooth connections, tracking sensors, LED brightness, touch sensitivity and LED indicator notifications.

The account settings preferably comprise privacy controls, cloud syncing, data collection, account info, community sharing and notifications.

The hardware controller preferably comprises adjust burst volume, smart volume adjustment (using heart rate monitor), and LED notifications.

A Blog preferably comprises performance, general health and wellness, charity news, environmental impacts and news, and technology.

A preferred embodiment of the present invention is a smart cap for a liquid container. The smart cap comprises a micro motor, a microcontroller, a wireless transceiver (BTLE), a lithium ion battery, a plurality of LED indicators, a waterproof rated charging port, a nozzle quick connect, a controllable valve, a touch sensor, a thermal sensor, a physical button, an impeller, and a cap housing.

In a more specific embodiment, the smart cap further comprises a pump. The pump is preferably a rotary-type positive displacement pump. The rotary-type positive displacement pumps is preferably selected from the group comprising an impeller pump, a flexible impeller pump, a rotary lobe pump, a velocity pump, an impulse pump, a gravity pump, a root-type pump, a valveless pump, a centrifugal pump, a rotary vane pump, a flexible vane pump, a circumferential piston pump, a rotary gear pump, a gear pump, a screw pump, a liquid ring pump, a helical twisted roots pump, a peristaltic pump, and a progressive cavity pump.

Alternatively, the pump is a reciprocating pump. The reciprocating pump is preferably selected from the group comprising a piston pump, a diaphragm pump, a positive displacement pump, a plunger pump, a radial piston pump and a hydraulic pump.

The smart cap further comprises an attachable hard-cover for extra protection and personalization. The smart cap further comprises a removable reservoir for easy cleaning and replacement. The smart cap further comprises a stretchable hose. The smart cap further comprises an adaptive gulp size.

An alternative embodiment of the present invention is a smart cap for a liquid container. The smart cap comprises a rechargeable battery, a microcontroller (with wireless transceiver/BTLE), a centrifuge pump (micro motor and impeller), and a plurality of LED light indicators.

Yet another alternative embodiment of the present invention is a system for a smart cap for a liquid container. The system comprises a smart cap, a mobile application for a mobile device, and a liquid container. The smart cap is attached to the liquid container.

The mobile application preferably comprises a hardware battery life, a daily goal tracking, a performance optimization, and a statistics view. A plurality of hardware settings comprise burst volume, Bluetooth connections, tracking sensors, LED brightness, touch sensitivity and LED indicator notifications.

As previously stated, U.S. Provisional Patent Application No. 62/405,949, filed Oct. 9, 2016, is hereby incorporated by reference in its entirety.

Another embodiment is a cap for a liquid container that consists of the following components. An electric motor to actively expel liquid from within the container. A microcontroller with BTLE for syncing with companion mobile app and sharing liquid consumption data. Liquid consumption data is determined by power supplied to motor; threading is sized to fit most standard wide mouth bottles. A Hall effect sensor is used to switch on and off activation button. When valve is open, activation button is in on state. When toggle valve is shut, activation button is in off state. This prevents motor from pumping while valve is shut. An open/shut valve for prevents liquid spills. An air inlet allows liquid to flow without generating a vacuum within the container. A pressure sensitive activation button for proving dynamic control over flow rate. The more force applied the higher the flow rate. A pump is positioned at the lower end of the hose to allow for self priming. An indicator light transmits information.

A secondary flow rate meter for liquid consumption tracking is optionally provided. The secondary meter may be a piston meter, a rotary piston meter, an oval gear meter, a gear meter, a helical gear meter, a nutating disk meter, a variable area meter, a turbine flow meter, a woltman meter, a single jet meter, a multiple jet meter, a paddle wheel meter, a pelton wheel meter, a current meter, a Venturi meter, an orifice plate meter, a Dall tube meter, a Pitot-tube meter, a multi-hole pressure probe, a cone meter, a linear resistance meter, an optical flow meter, a laser-based optical flow meter, a level to flow meter (bubbler, ultrasonic, float, a differential pressure), an area velocity (Doppler or Propeller), a vortex flow meter, a sonar flow meter, an electromagnetic flow meter, an ultrasonic flow meter, a magnetic flow meter, a Coriolis flow meter, or a laser Doppler flow meter.

Figure 1A:
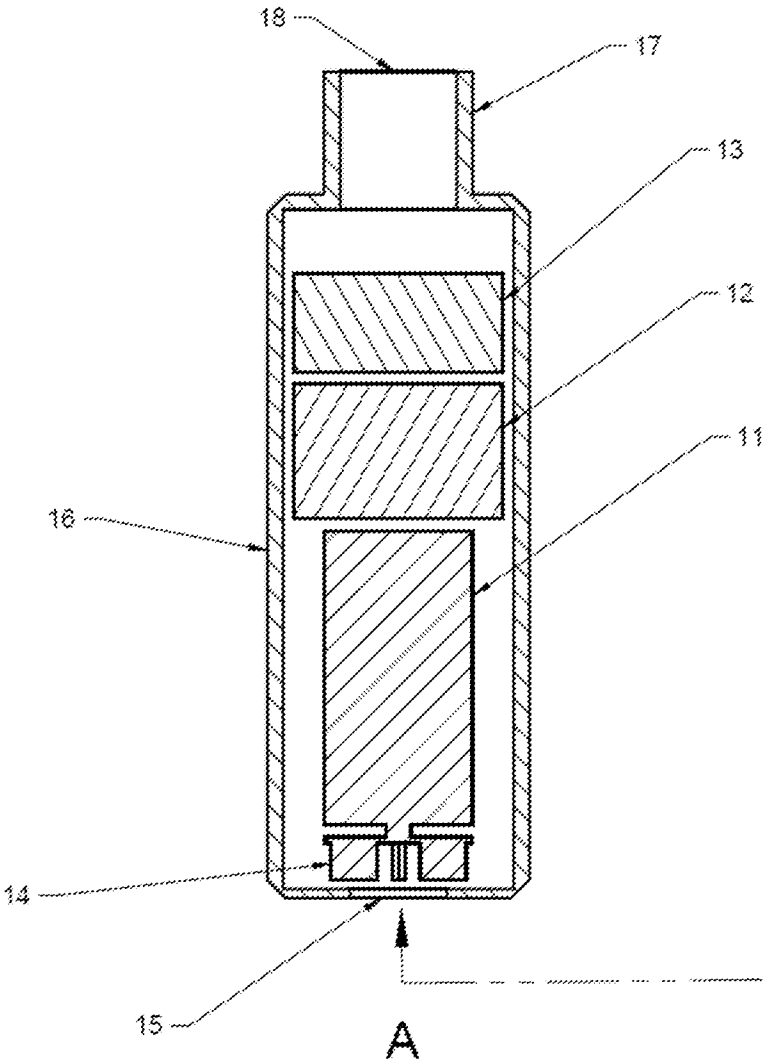
FIG. 1A is a cross-sectional view along line A-A of FIG. 1.

As shown in FIGS. 1 and 1A, a liquid container has an electric motor 11, a first module 12, a second module 13, an impeller 14, a water inlet 15, a motor & module housing 16, a hose connect 17 and a water outlet 18.

Figure 2A:
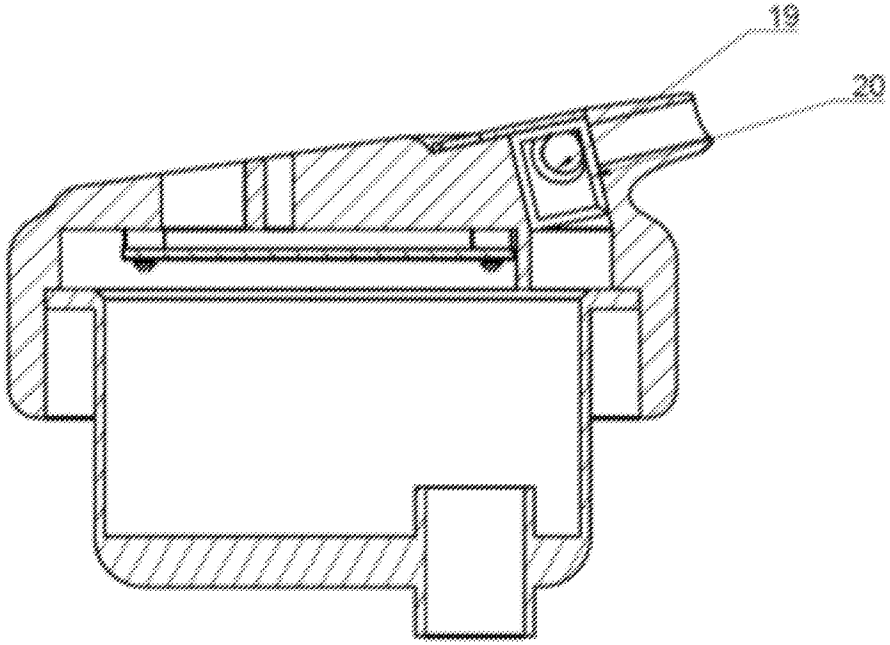
FIG. 2A is a cross-sectional view of the smart cap of FIG. 2.
Figure 2:
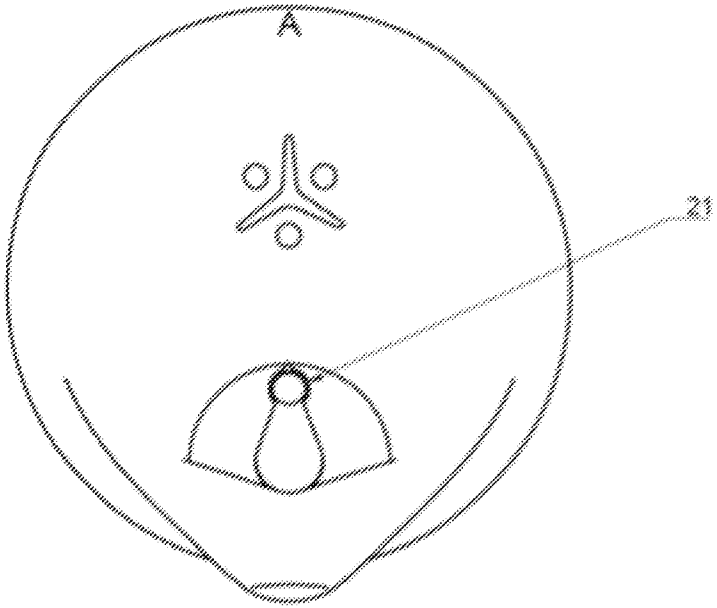
FIG. 2 illustrates a smart cap.

FIGS. 2 and 2A illustrate a rotational valve open state 19, a rotational valve closed state 20 and a rotational valve lever arm 21.

Figure 3B:
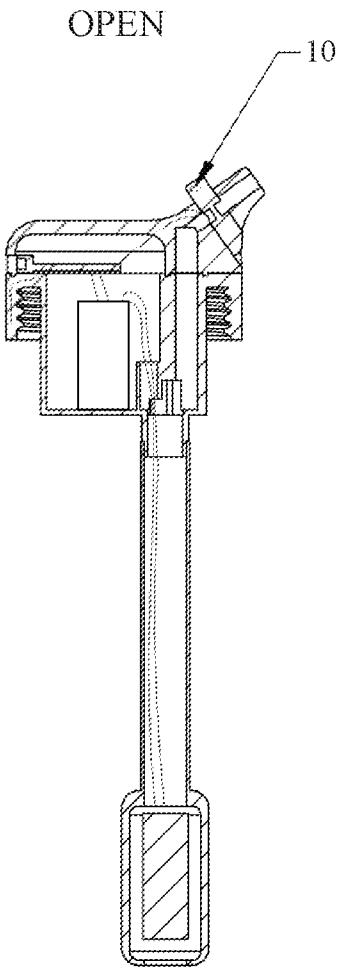
FIG. 3B is a cross-sectional view of the smart cap of FIG. 3.
Figure 3A:
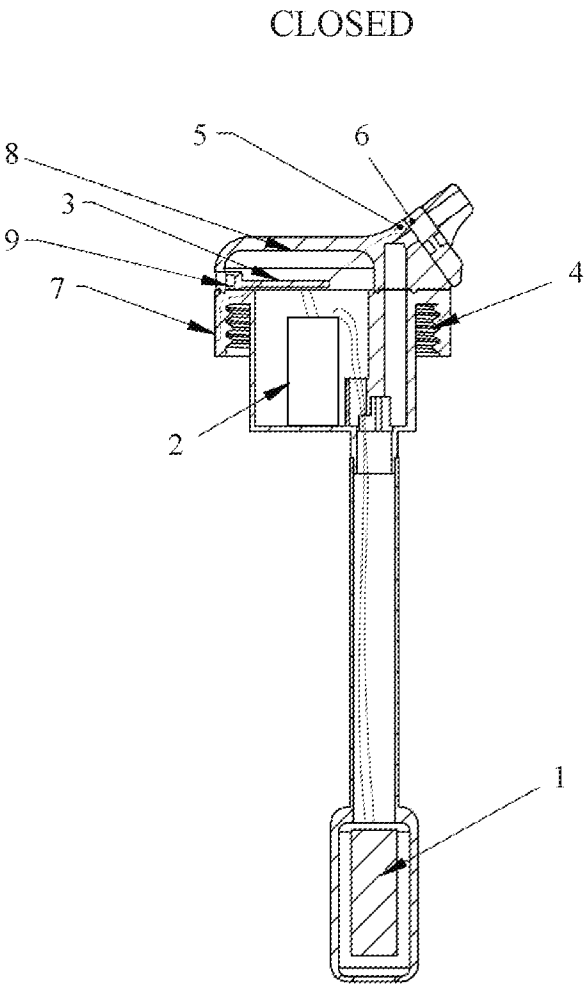
FIG. 3A is a cross-sectional view of the smart cap of FIG. 3.
Figure 3:
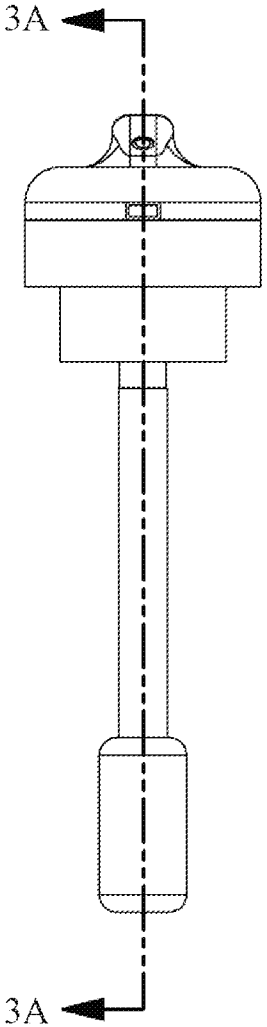
FIG. 3 illustrates a smart cap with a stem.
Figure 6:
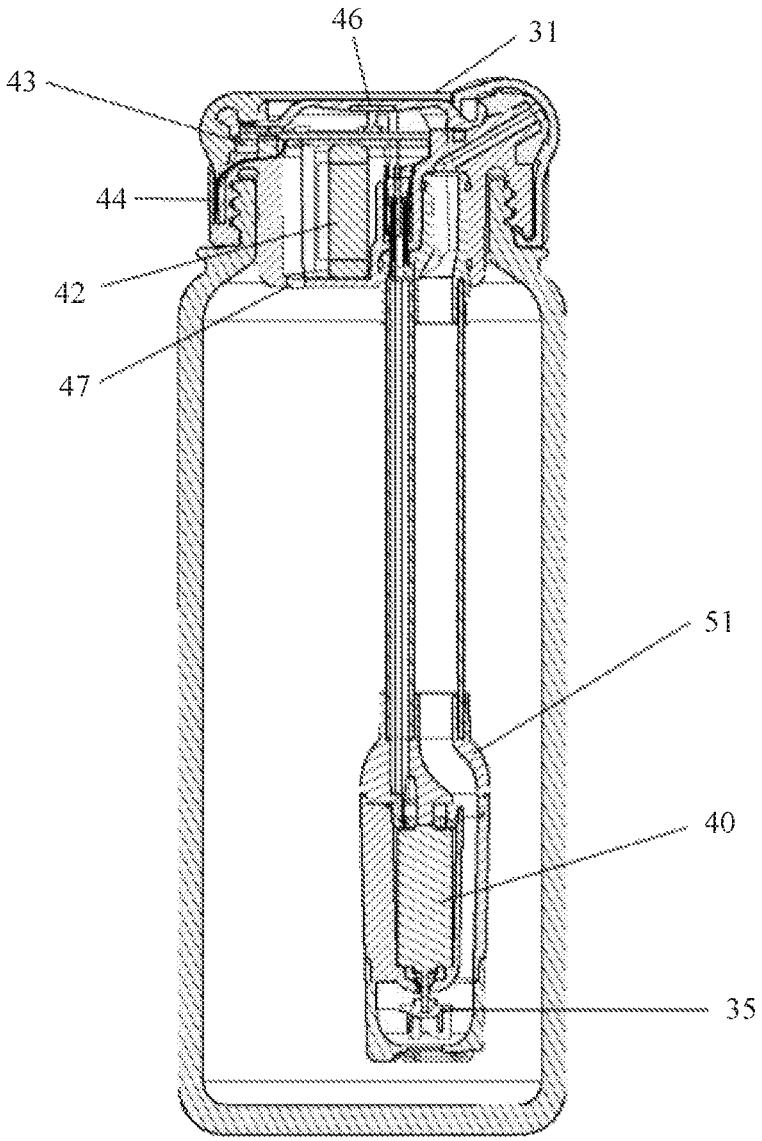
FIG. 6 illustrates a cross sectional view of a smart cap on a liquid container.
Figure 7:
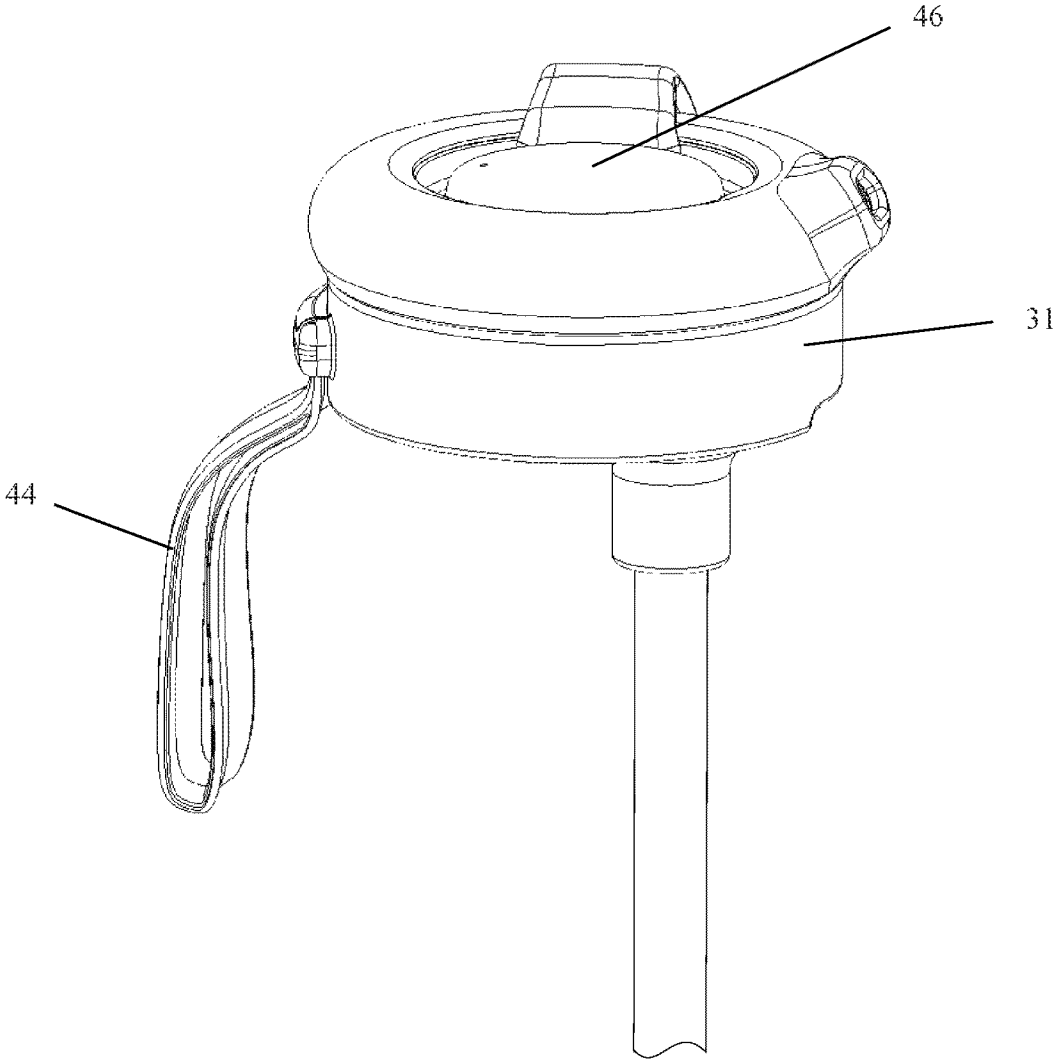
FIG. 7 is a top perspective view of a smart cap with a stem.

FIGS. 3, 3A and 3B illustrate an embodiment of a smart cap 20 with an electric motor pump 1, a rechargeable battery 2, a circuit board 3, threading 4, a Hall effect sensor 5, a toggle valve 6, a switch or pressure sensor 7, an indicator light 8, a charging port 9, an embedded magnet 10 (for activation of hall effect sensor). As shown in FIG. 6, a smart cap has a cap housing 31, a touch sensor 46, a waterproof rated charging port 43, a physical button 44, a lithium ion battery 42, a thermal sensor 47, a centrifugal pump 51, a micro-motor 40 and an impeller 35. As shown in FIG. 7, a smart cap has a cap housing 31, a physical button 44 and a touch sensor 46.

A detachable downstem that makes a watertight electrical connection to a smart cap. This allows for different size down downstems to be used with the same cap unit. This smart connector can be used for other accessories including but not limited to: a heating element, a powered mixer (for mixing protein shakes and nutritional supplements), a UV light purifier, a filter, an infuser and a hydrogen water generator.

Figure 4:
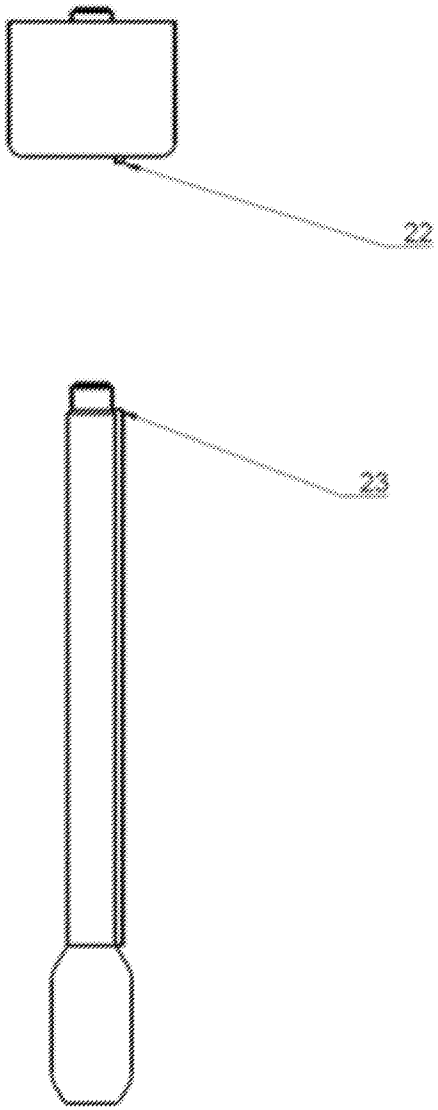
FIG. 4 illustrates a water-tight electrical connection.

FIG. 4 illustrates a water-tight electrical connection (Smart cap receiving end) 22 and a water-tight electrical connection (downstem end) 23.

Figure 5:
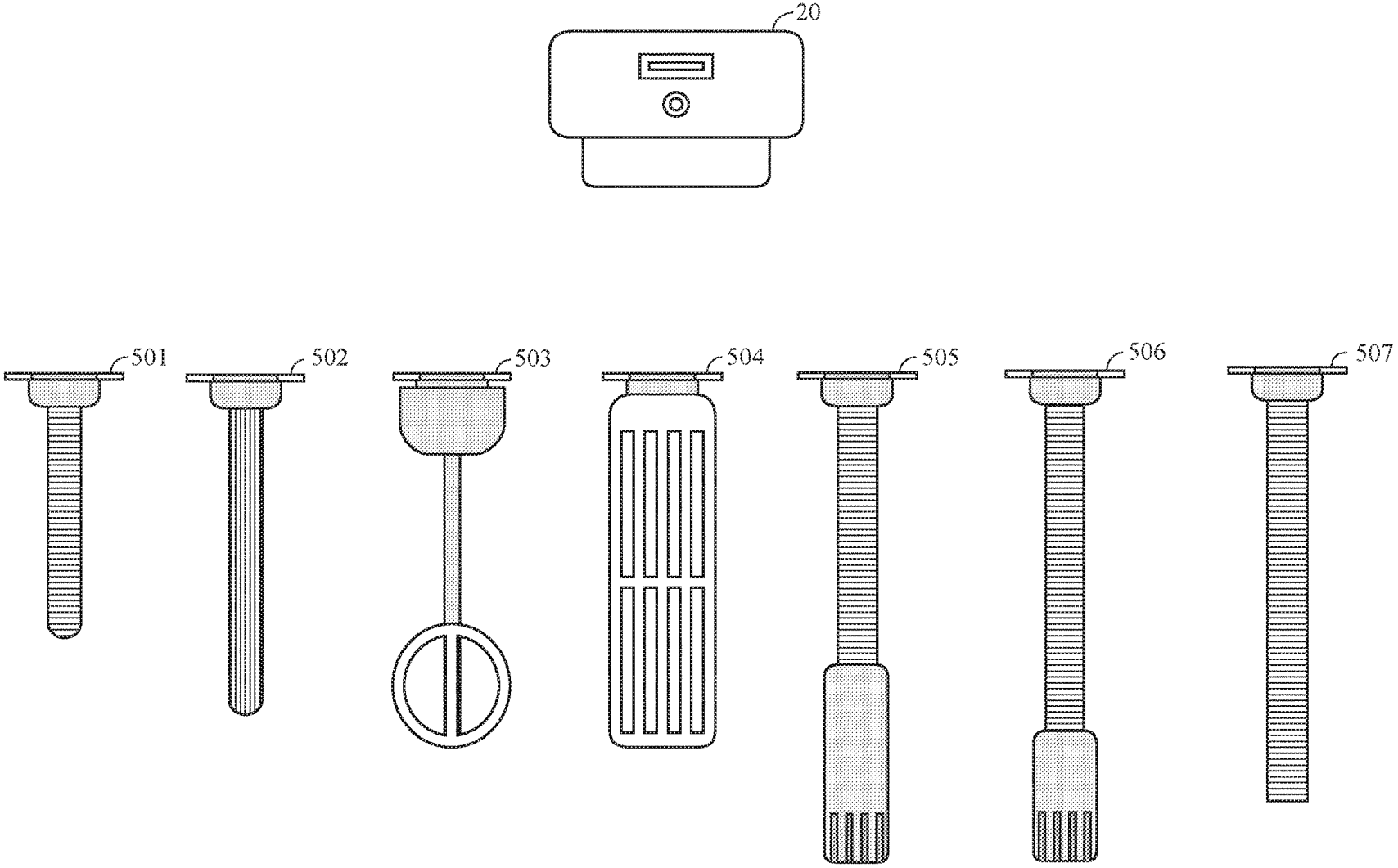
FIG. 5 illustrates a smart cap and inline modules.

As shown in FIG. 5, an inline module, selected from a UV purifier inline module 501, a heater inline module 502, a mixer inline module 503, an infuser inline module 504, a pump inline module 505, a filter inline module 506 and a simple hose inline module 507, is a replaceable insert that can be used with a smart cap 20 for: Filtering; UV light purification; Making water more alkaline; Mineral infusion; Flavor infusion; Vitamin & supplement infusion; and/or Hydrogen water generator.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention the following:

1. A cap for a liquid container, the cap comprising:

a cap housing configured to be positioned on a top of a liquid container;

a controller positioned within the housing;

a battery positioned within the housing;

a valve; and a centrifugal pump comprising an impeller and a motor, the centrifugal pump connected to the cap housing, wherein the centrifugal pump extends downward from the cap housing, and is configured to be positioned within a body of a liquid container, wherein the impeller is positioned at a bottom of the centrifugal pump and the motor is positioned above the impeller;

wherein the impeller is powered by the motor which is controlled by the controller;

wherein the impeller draws liquid upward toward an opening in the cap housing.

2. The cap according to claim 1 further comprising a hose.

3. A cap for a liquid container, the cap comprising:

a cap housing configured to be positioned on a top of a liquid container;

a controller positioned within the housing;

a battery positioned within the housing;

a valve; and a centrifugal pump comprising an impeller and a motor, the centrifugal pump connected to the cap housing, wherein the centrifugal pump extends downward from the cap housing to a bottom of the liquid container, and is configured to be positioned within a body of a liquid container, wherein the impeller is positioned at a bottom of the centrifugal pump and the motor is positioned above the impeller;

wherein the impeller is powered by the motor which is controlled by the controller;

wherein the impeller draws liquid upward toward an opening in the cap housing.

* * * * *